US009794663B1

(12) United States Patent
Fountain

(10) Patent No.: US 9,794,663 B1
(45) Date of Patent: Oct. 17, 2017

(54) ICE RESISTANT SPEAKER

(71) Applicant: SYMBOL TECHNOLOGIES, LLC, Lincolnshire, IL (US)

(72) Inventor: Mark Thomas Fountain, London (GB)

(73) Assignee: Symbol Technologies, LLC, Holtsville, NY (US)

( * ) Notice: Subject to any disclaimer, the term of this patent is extended or adjusted under 35 U.S.C. 154(b) by 0 days.

(21) Appl. No.: 15/159,301

(22) Filed: May 19, 2016

(51) Int. Cl.
*H04R 25/00* (2006.01)
*H04R 1/02* (2006.01)

(52) U.S. Cl.
CPC ..... *H04R 1/026* (2013.01); *H04R 1/023* (2013.01); *H04R 2499/11* (2013.01)

(58) Field of Classification Search
CPC ..... H04R 1/026; H04R 1/023
See application file for complete search history.

(56) References Cited

U.S. PATENT DOCUMENTS 5,031,220 A * 7/1991 Takagi ..... B60R 11/0217 181/155
2005/0276432 A1* 12/2005 Hsieh ..... H04R 1/345 381/341
2013/0058065 A1* 3/2013 Minaguchi ..... H04N 5/64 361/807
2014/0294216 A1* 10/2014 Teng ..... H04R 1/02 381/334
2014/0301591 A1* 10/2014 Yang ..... H04R 1/1016 381/380
2014/0348372 A1* 11/2014 Seo ..... H04R 1/1016 381/380

OTHER PUBLICATIONS

Zebra Technologies, "VC80 Vehicle-Mounted Computer Brochure", pp. 1-10 [retrieved on May 18, 2016 from https://www.zebra.com/us/en/products/mobile-computers/vehicle-mounted/vc80.html].
Zebra Technologies, "VC-80 Specification Sheet", pp. 1-2, Copyright 2016 [retrieved from https://www.zebra.com/content/dam/zebra_new_ia/en-us/solutions-verticals/product/Mobile_Computers/Vehicle-Mounted/vc80-vehicle-mounted-computer/spec-sheet/vc80-specification-sheet-a4.pdf].

* cited by examiner

*Primary Examiner* — Simon King

(57) ABSTRACT

An ice resistant speaker is provided. The ice resistant speaker can be incorporated into a device comprising a housing having an outer surface and an inner surface opposite the outer surface. The ice resistant speaker comprises: an audio port at the housing, the audio port comprising: a cavity at the outer surface of the housing; an aperture through the housing, the aperture located in the cavity; and a speaker pill located in the cavity and forming a gap with sidewalls of the cavity, the speaker pill mounted in front of the aperture using one or more flexible pads; and, a speaker driver located adjacent the inner surface of the housing, and further adjacent the aperture.

13 Claims, 12 Drawing Sheets

ICE RESISTANT SPEAKER

BACKGROUND

Mobile devices that include speakers can be used in a variety of environments from warm humid conditions to cold store freezers. In some circumstances, mobile devices, such as those used in warehousing applications, could be passing between these environments frequently. In such situations condensation can start to freeze onto the mobile device. Speakers that include speaker grills have many narrow surfaces that form apertures, and ice can quickly build up between the apertures. As such, ice can quickly grow on a speaker grill, for example by locking onto and blocking the apertures. This can dramatically reduce the speaker performance and possibly cause damage. While speakers and/or speaker grills can be provided with heating elements and heated therewith to reduce ice build-up, such heating elements lead to extra complexity and extra power consumption, the latter of which is especially undesirable in mobile devices.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate implementations of concepts described herein, and explain various principles and advantages of those implementations.

Figure 1:
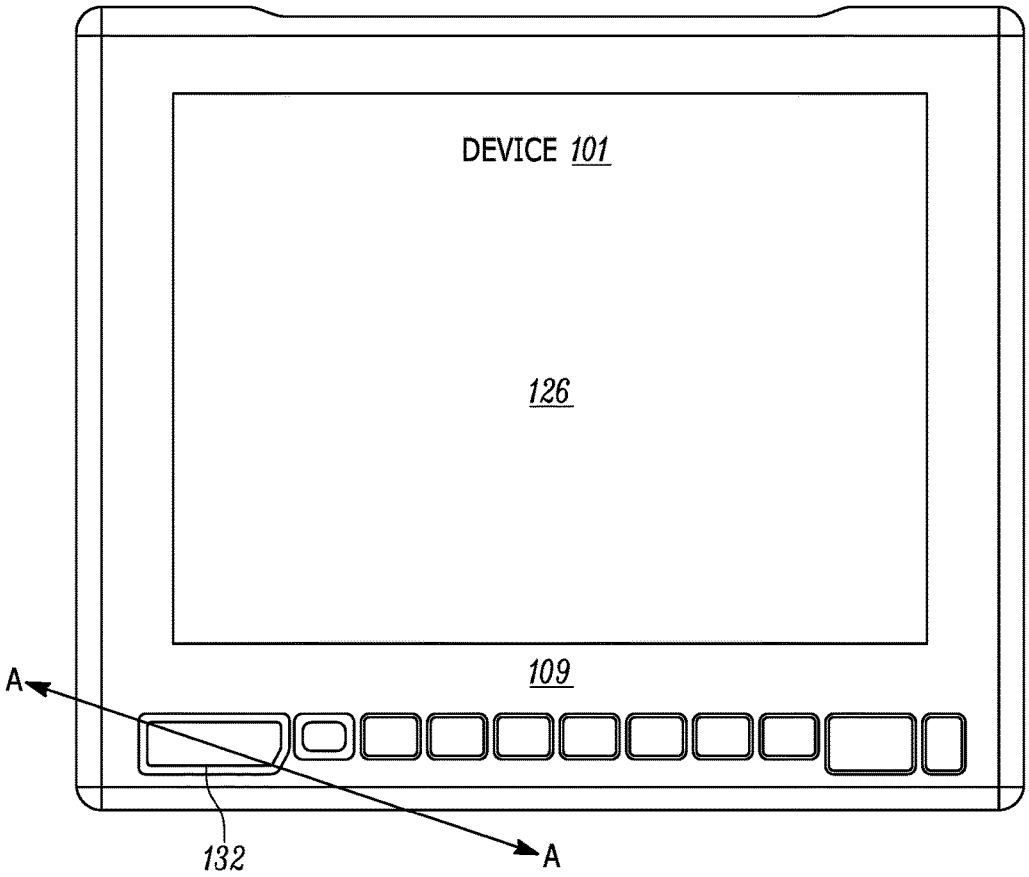
FIG. 1 depicts a schematic diagram of a device that includes an ice resistant speaker, according to non-limiting implementations.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations of the present specification.

The apparatus and method components have been represented where appropriate by conventional symbols in the drawings, showing only those specific details that are pertinent to understanding the implementations of the present specification so as not to obscure the disclosure with details that will be readily apparent to those of ordinary skill in the art having the benefit of the description herein.

DETAILED DESCRIPTION

An aspect of the specification provides a device comprising: a housing comprising an outer surface and an inner surface opposite the outer surface; an audio port at the housing, the audio port comprising: a cavity at the outer surface of the housing; an aperture through the housing, the aperture located in the cavity; and a speaker pill located in the cavity and forming a gap with sidewalls of the cavity, the speaker pill mounted in front of the aperture using one or more flexible pads; and, a speaker driver located adjacent the inner surface of the housing, and further adjacent the aperture.

The speaker pill can comprise a sound reflector, which in one embodiment also acts as a deflector (e.g., deflecting objects, water jets, and the like).

The speaker pill can be one or more of solid, rigid, aperture-free, and have continuous external surfaces.

A total area of the gap between the speaker pill and the sidewalls of the cavity at the outer surface can be selected by determining an equivalent area of apertures in a speaker grill replaced by the speaker pill, and setting the total area to the equivalent area of the apertures of such speaker grill.

In an embodiment, a total area of the gap between the speaker pill and the sidewalls of the cavity at the outer surface is less than or equal to an area of an outer surface of the speaker pill.

The speaker pill can have a shape complementary to the sidewalls of the cavity.

The speaker pill can have a shape complementary to the sidewalls of the cavity, and respective corners of each of the speaker pill and the sidewalls are rounded.

In one embodiment, each of sides of the speaker pill, and the sidewalls of the cavity, are one or more of smooth, glossy, and coated with a hydrophobic material.

Sides of the speaker pill, and the sidewalls of the cavity can be tapered outwards towards the outer surface with respect to one another such that the gap widens from the inner surface to the outer surface of the housing.

Sides of the speaker pill, and the sidewalls of the cavity can each have a plurality of complementary facets that extend around each of the sides of the speaker pill, and the sidewalls of the cavity, each of the plurality of complementary facets being tapered outwards towards the outer surface with respect to one another such that the gap widens from the inner surface to the outer surface of the housing.

The speaker pill can be flexible.

The one or more flexible pads can each extend between a side of the cavity that is adjacent the aperture, to the speaker pill.

Each of the one or more flexible pads can extend from an adjacent arm that extends into the aperture, to the speaker pill.

Attention is first directed to FIG. 1 which depicts a front view of a device 101 comprising a housing 109, a display device 126, and a speaker 132, which is described in further detail below. As depicted, device further comprises at least one input device, such as keys adjacent speaker 132. While not depicted, device 101 can also include, but is not limited to, at least one processor, at least one memory, at least one microphone, at least one camera device and indeed, any components that provide computing functionality and/or communication functionality and/or warehousing functionality to device 101. However, the specific functionality of device 101 is not to be considered particularly limiting, and indeed, device 101 can comprise any device that includes a processor, and the like, configured to control speaker 132 to emit sound.

As such, device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances, mobile camera devices and the like. Other suitable devices are within the scope of present implementations; in particular, device 101 can be integrated with a vehicle and/or a vehicle can include speaker 132 and a processor to drive speaker 132. Indeed, as depicted, device 101 comprises a vehicle mountable device.

While specific implementations are described herein with respect to device 101 comprising a mobile communication device which is mountable in a vehicle, device 101 need not comprise a mobile communication device, but rather can comprise a device with any specialized functions, for example a device having warehouse inventory tracking and/or other data acquisition functionality, such as a mobile scanner having one or more of radio frequency identification (RFID) reader, Near Field Communication (NFC) reader, imager, and/or laser-based scanner data acquisition components.

As such, while a specific physical configuration of device 101 is depicted in FIG. 1, other physical configurations of device 101 are within the scope of present implementations. For example, when device 101 comprises a mobile scanner, device 101 can further include one or more handles, such as a handle below display device 126, as well as a trigger for triggering data acquisition components and the like.

In particular, device 101 can be mobile and/or portable and/or used in environments that can cause condensation and ice to form on speaker 132. However, as compared to speakers that include speaker grills (i.e. a plurality of apertures through which sound is emitted), speaker 132 has a reduced number of edges from on which ice can grow, a larger distance from edge to edge that is aperture-free, thereby reducing distances between which ice can span such that ice is less likely to join up and/or build up, and straight edges to relatively decrease the chance of ice finding a purchase on the edges. As well, as speaker 132 has a relatively flat top side and/or outer side, and rounded edges at least in a gap with housing 109, ice tends to adhere to the top side and/or outer side so ice can fall away from device 101.

Furthermore, while a specific position, shape and relative size of speaker 132 is depicted in FIG. 1, other positions, shapes and sizes are within the scope of present implementations. For example, while speaker 132 is depicted as being "below" display device 126, and at a front side of device 101, speaker 132 can be located at a back side of device 101, on edges and/or sides of device 101, "below" display device 126, and indeed, any suitable position on device 101. While speaker 132 is depicted as generally being asymmetrically pentagonal, having five sides, speaker 132 can comprise one side (e.g. speaker 132 can be round, elliptical, and the like) or speaker 132 can comprise a plurality of sides, and can be generally symmetrical or generally asymmetrical.

Furthermore, while device 101 is depicted has comprising one speaker 132, device 101 can comprise a plurality of speakers, which can be functionally similar to speaker 132 (though others of the plurality of speakers can have different shapes, sizes, positions, and the like).

Figure 2:
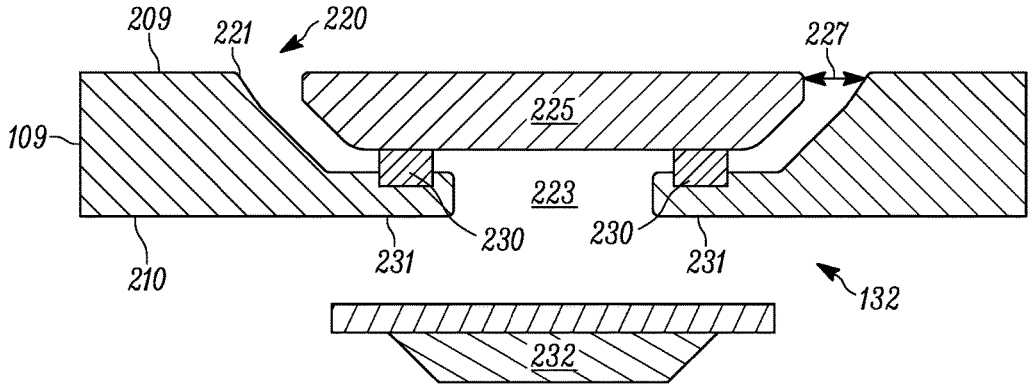
FIG. 2 depicts a schematic cross-section of the ice resistant speaker, according to non-limiting implementations.

Attention is next directed at FIG. 2 which depicts a schematic cross-section of a portion of device 101 through speaker 132 through a line A-A of FIG. 1, and hence depicts details of speaker 132. However, FIG. 2 is not to scale, and is meant merely to show functional elements of speaker 132 rather than actual relatives sizes of such elements, etc.

In particular, as depicted in FIG. 2, device 101 comprises: housing 109 comprising an outer surface 209 (as also depicted in FIG. 1) and an inner surface 210 opposite outer surface 209; an audio port 220 at housing 109, audio port 220 comprising: a cavity 221 at outer surface 209 of housing 109; an aperture 223 through housing 109, aperture 223 located in cavity 221; and a speaker pill 225 located in cavity 221 and forming a gap 227 with sidewalls of cavity 221, speaker pill 225 mounted in front of aperture 223 using one or more flexible pads 230; and, a speaker driver 232 located adjacent inner surface 210 of housing 109, and further adjacent aperture 223.

As depicted, flexible pads 230 are mounted on arms 231, which are described hereafter. Indeed, attention is briefly directed to FIG. 3 which depicts the corner of device 101 where speaker 132 is located, and in particular depicts a front view of speaker 132 with speaker pill 225 removed. Hence FIG. 3 further depicts locations of flexible pads 230, and arms 231 at corners of aperture 223 on which flexible pads 230 are mounted, as well as a location of aperture 223 relative to cavity 221. As depicted, arms 231 generally extend from opposite corners of aperture 223 towards a center of aperture 223, and are semi-circular in shape; however, arms 231 can be located at other positions in aperture 223 and be other shapes. Furthermore, in some implementations, arms 231 can be flexible.

Figure 3:
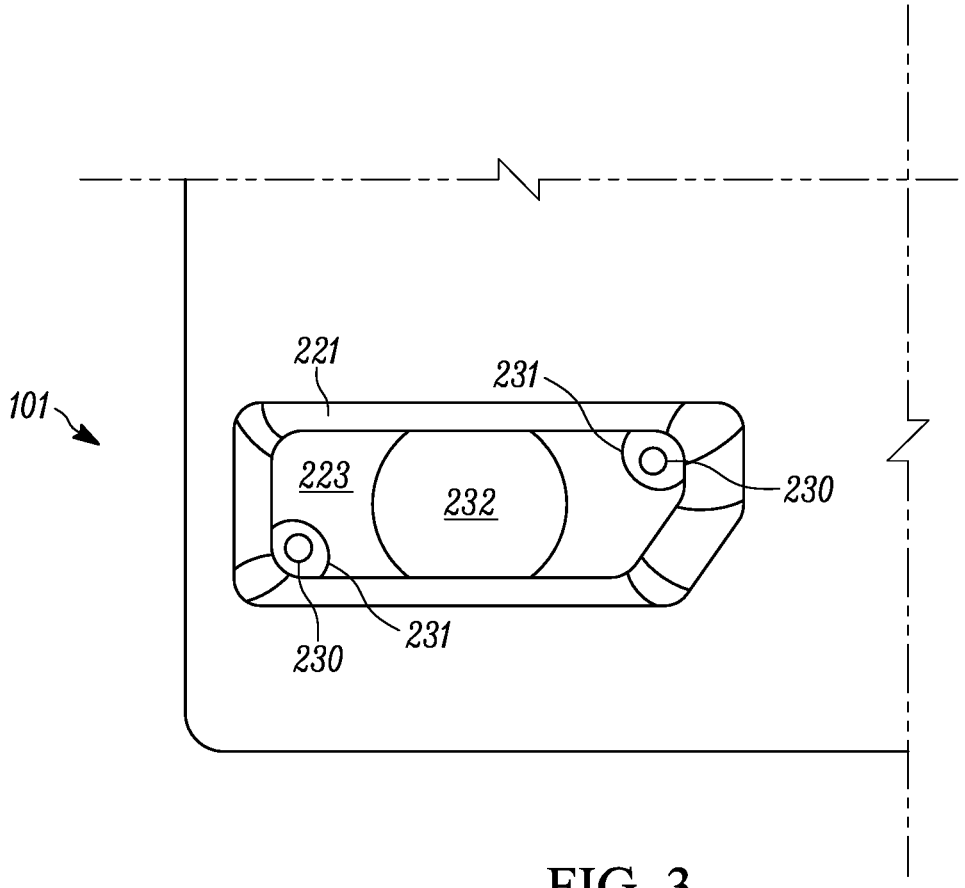
FIG. 3 depicts a corner of the device of FIG. 1 with a speaker pill of the ice resistant speaker removed to show positions of flexible pads upon which the speaker pill is mounted, according to non-limiting implementations.

While two flexible pads 230 and two arms 231 are depicted in FIG. 3, located at opposite corners of aperture 223 (and hence at opposite corners of speaker pill 225, as depicted in FIG. 2), device 101 can comprises one flexible pad 230 suspended in front of speaker driver 232 (e.g. on an arm in aperture 223, over aperture 223 and/or under aperture 223), for example about at a center of aperture 223.

In any event, as depicted in FIGS. 2 and 3, each of one or more flexible pads 230 extends from a respective arm 231 that extends into aperture, to speaker pill 225. Alternatively, one or more flexible pads 230 can each extend between a side of cavity 221, which is adjacent aperture 223, to speaker pill 225. Attachment points of each of flexible pads 230 to arms 231 (and/or a side of cavity 221), and to speaker pill 225 can comprise any suitable combination of fasteners, glue, epoxy, bonding, and the like.

Furthermore, each of one or more flexible pads 230 can comprise a flexible material including, but not limited to, silicone, rubber and the like. Put another way, in some implementations, each of one or more flexible pads 230 can be pliable and/or deformable, and the like. In yet further implementations one or more of flexible pads 230 can be rendered flexible by way of a mechanical structure; for example, at least a portion of one or more of flexible pads 230 can comprise springs, and the like. Such flexibility will be described in more detail below Attention is next directed back to FIG. 2. In general, a processor of device 101 drives speaker driver 232 to emit sound, which is directed through aperture 223, around one or more flexible pads 230 and speaker pill 225, and through gap 227 of audio port 220. In particular speaker pill 225 comprises a deflector and/or sound reflector that is provided in one piece, is generally solid, and aperture-free. However, such solidity is meant to refer only to external surfaces of speaker pill 225 being continuous and/or aperture free, and speaker pill 225 could be at least partially hollow, for example to reduce weight and/or for ease of use in some manufacturing processes that could be used to form speaker pill 225, such as injection molding.

In other words, speaker pill 225 does not include apertures and/or a speaker grill on which ice can form. Indeed, speaker pill 225 generally replaces a speaker grill of a traditional speaker. For example, sound exits speaker 132 around speaker pill 225 through gap 227, but does not travel through speaker pill 225. Put another way, an area of gap 227 and/or audio port 220 can be continuous, and speaker pill 225 can be aperture-free.

Hence, to ensure that a quality and/or intensity and/or power of sound exiting speaker 132 is not affected by speaker pill 225, a total area of gap 227 between the speaker pill 225 and sidewalls of cavity 221 at outer surface 209 can be selected (for example in a design phase) by determining an equivalent area of apertures of a speaker grill replaced by speaker pill 225, and setting the total area of gap 227 to the equivalent area of the apertures of the speaker grill. For example, a speaker grill according to the prior art has a plurality of apertures through which sound from a speaker driver can pass; hence, so as to achieve a similar sound level the total area of gap 227 can be set to equivalent area of the apertures of the speaker grill that is being replaced by speaker pill 225.

For example, in some implementations, assuming that an area of an outer side of speaker pill 225 is similar to an area of apertures of a speaker grill being replaced by speaker pill 225, a total area of gap 227 can be selected (for example in a design phase) to be less than or equal to an area of the outer side of speaker pill 225. In other words, total area of gap 227 between speaker pill 225 and the sidewalls of cavity 221 at outer surface 209 can be less than or equal to an area of an outer side of speaker pill 225.

Furthermore, an area of flexible pads 230 that at least partially block gap 227 adjacent aperture 223 is generally selected as to not interfere with exiting of sound through gap 227. In other words, a lateral area (e.g. an area blocking exiting of sound emitted by speaker driver 232) of flexible pads 230 is generally small (e.g. less than about 10%) as compared to a total area of gap 227 between speaker pill 225 and the sidewalls of cavity 221 at outer surface 209. Indeed, to account for loss of sound due to an area of flexible pads 230, a total area of gap 227 between speaker pill 225 and the sidewalls of cavity 221 at outer surface 209 can be widened accordingly (e.g. relative to an area of a speaker grill being replaced by speaker pill 225).

With reference to both FIG. 1 and FIG. 2, as depicted, speaker pill 225 can have a shape complementary to sidewalls of cavity 221. Furthermore, as depicted, speaker pill 225 can have a shape complementary to sidewalls of cavity 221, and respective corners of each of speaker pill 225 and the sidewalls of cavity 221 can be rounded. As is further depicted in FIG. 2, as depicted, each of sides of speaker pill 225, and the sidewalls of cavity 221, can be smooth. As will be explained hereafter, such features, when present, can assist with removal of ice that forms between speaker pill 225 and sidewalls of cavity 221.

As is yet further depicted in FIG. 2, sides of speaker pill 225, and the sidewalls of cavity 221 can be tapered outwards towards outer surface 209 of housing 109, with respect to one another, such that gap 227 widens from inner surface 210 to outer surface 209 of housing 109. As will be explained hereafter, such tapering, when present, can assist with removal of ice that forms between speaker pill 225 and sidewalls of cavity 221.

As is yet further depicted in FIG. 2, sides of speaker pill 225, and the sidewalls of cavity 221 can each have a plurality of complementary facets that extend around each of the sides of speaker pill 225, and the sidewalls of cavity 221, and each of the plurality of complementary facets can be tapered outwards towards outer surface 209 of housing 109, with respect to one another, such that gap 227 widens from inner surface 210 to outer surface 209 of housing 109.

Indeed, widening of gap 227 can be provided in any suitable manner; in other words, aesthetics and design of speaker pill 225 can be varied, as long as gap 227 widens from inner surface 210 to outer surface 209 of housing 109. Such widening need not be continuous, and furthermore portions of gap 227 can be parallel and/or not tapered, for example towards an interior of speaker 132.

Speaker pill 225 is generally rigid, for example as compared to flexible pads 230, such that pressure applied to speaker pill 225 is translated, by speaker pill 225 to flexible pads 230, which can be deformed by such pressure and hence cause speaker pill 225 to move relative to cavity 221. Such movement is now described with reference to FIG. 4, FIG. 5, FIG. 6 and FIG. 7, each of which is substantially similar to FIG. 2, with like elements having like numbers.

Figure 4:
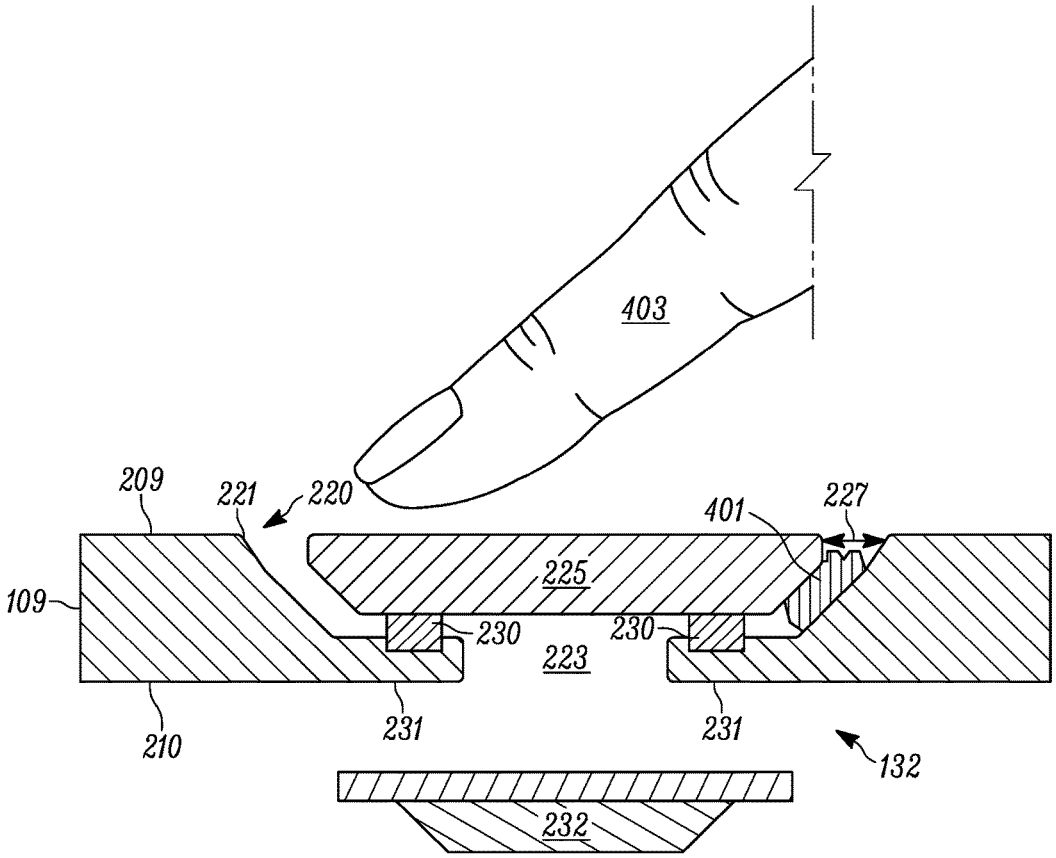
FIG. 4 depicts the ice resistant speaker of FIG. 2 with ice that has formed in a gap, according to non-limiting implementations.

Hence, attention is first directed to FIG. 4, which depicts ice 401 that has formed in gap 227 between speaker pill 225 and sidewalls of cavity 221, for example, to condensation and device 101 being transported from a warm humid environment to a cool environment. FIG. 4 further depicts a finger 403 of a user that can interact with speaker pill 225 to eject ice 401 from gap 227 in various operational modes, as described hereafter.

Figure 5:
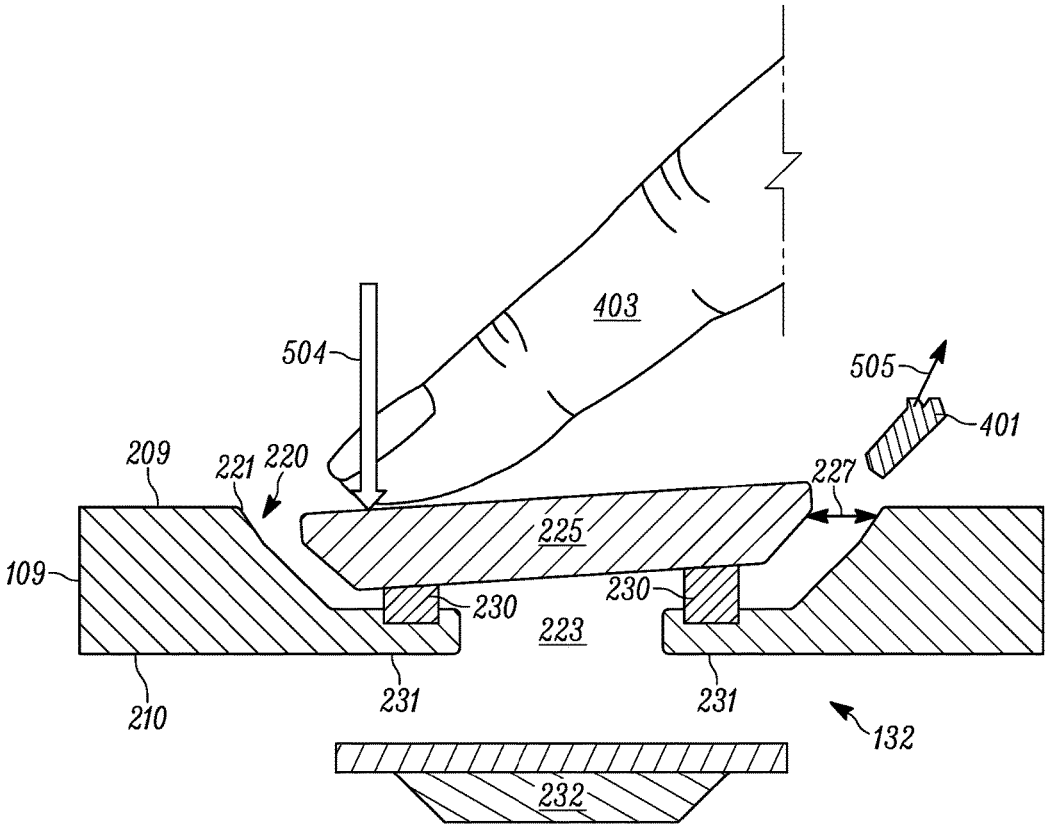
FIG. 5 depicts a finger of a user interacting with the ice resistant speaker of FIG. 4 to eject the ice from the gap, in a first operational mode, according to non-limiting implementations.

With reference to FIG. 5, which depicts a first operational mode of speaker 132 for removing ice 401 from gap 227, finger 403 can apply pressure (as indicated by arrow 504) to a top side and/or outer side of speaker pill 225, adjacent an edge and/or side of speaker pill 225, which causes speaker pill 225 to pivot and/or swing and/or rock, as one flexible pad 230 compresses and the other flexible pad 230 extends. As depicted, finger 403 is applying pressure to speaker pill 225 on a side opposite ice 401. The movement of speaker pill 225 causes ice 401 to be ejected from gap 227 (e.g. as indicated by arrow 505) as the edge of speaker pill 225 in contact with ice 401 moves outward.

Figure 6:
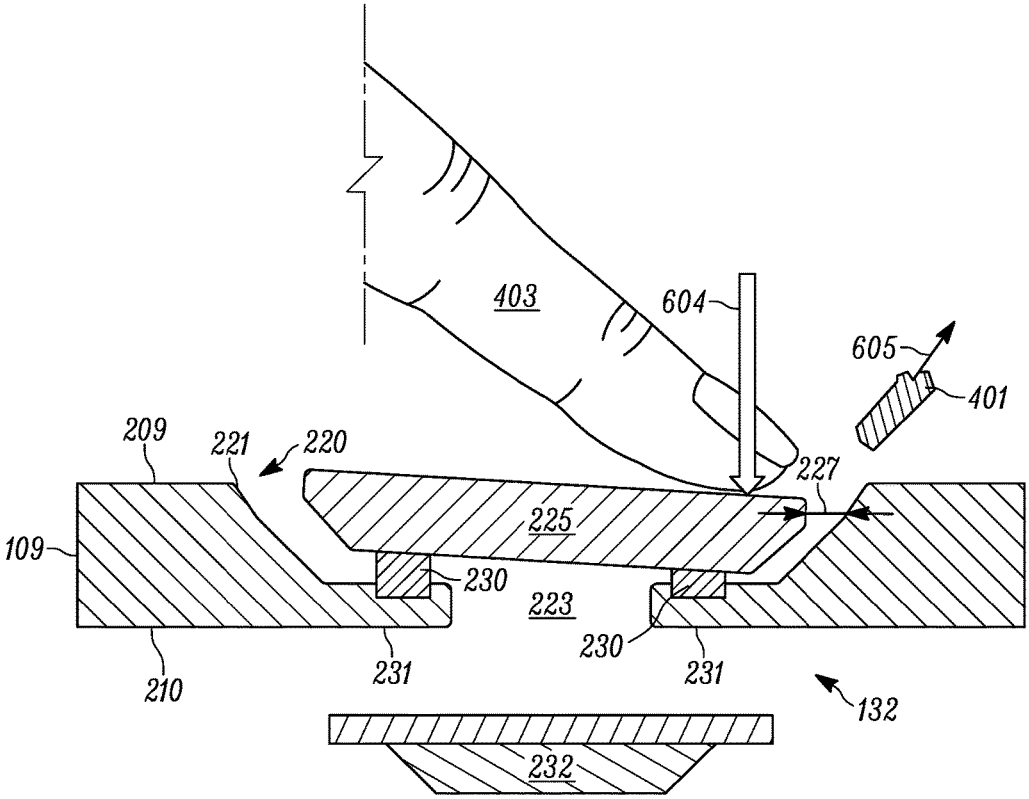
FIG. 6 depicts a finger of a user interacting with the ice resistant speaker of FIG. 4 to eject the ice from the gap, in a second operational mode, according to non-limiting implementations.

However, with reference to FIG. 6, which depicts a second operational mode of speaker 132 for removing ice 401 from gap 227, finger 403 can alternatively apply pressure (as indicated by arrow 604) to a top side and/or outer side of speaker pill 225, adjacent ice 401. Such pressure generally causes gap 227 to narrow as speaker pill 225 rocks into cavity 221 adjacent ice 401 (as flexible pads 230 again compress and extends according to the pressure applied to speaker pill 225), which, due to the tapering of gap 227, causes ice 401 to be ejected from gap 227 (e.g. as indicated by arrow 605).

Figure 7:
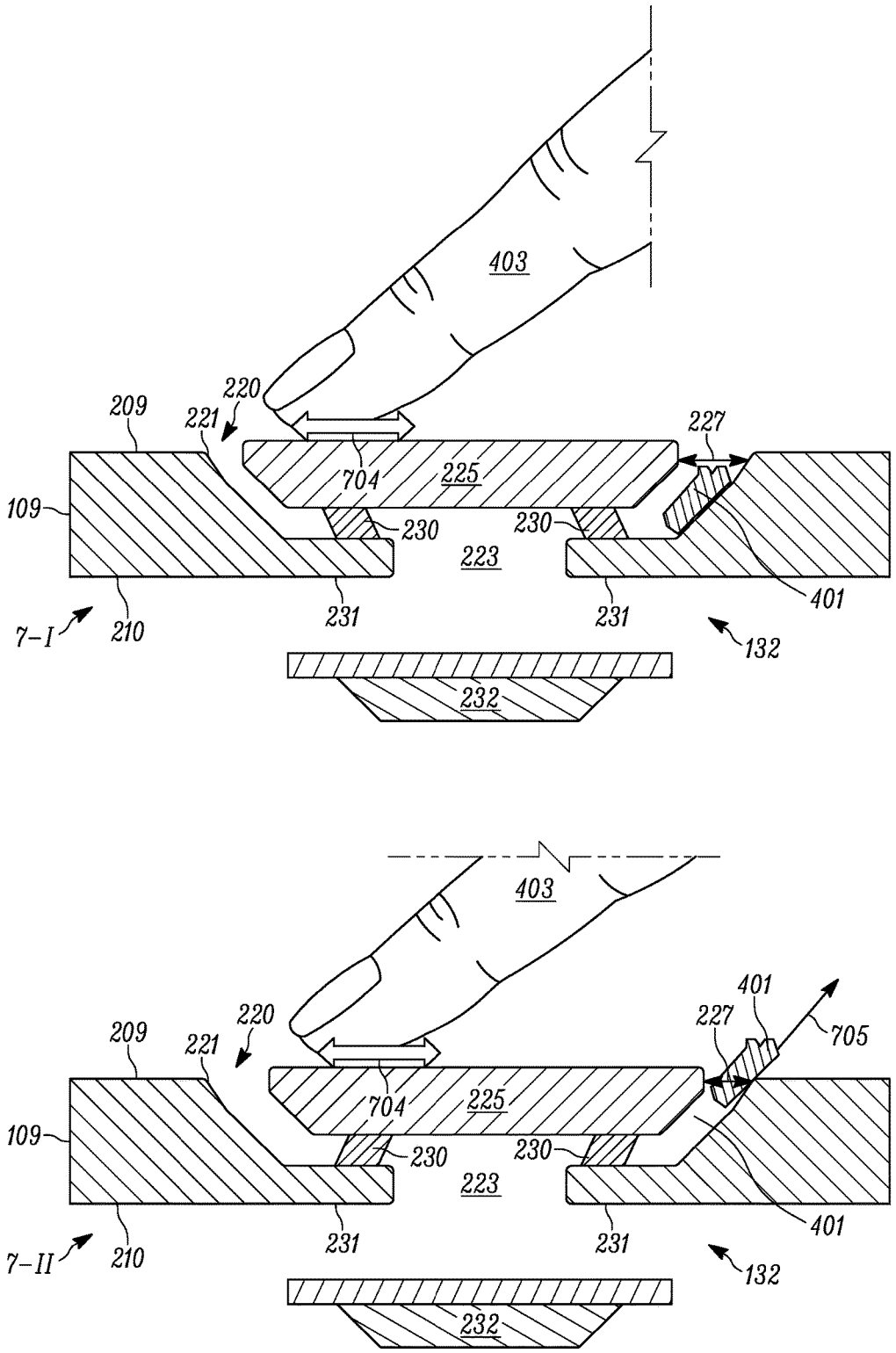
FIG. 7 depicts a finger of a user interacting with the ice resistant speaker of FIG. 4 to eject the ice from the gap, in a third operational mode, according to non-limiting implementations.

Attention is next directed to FIG. 7, which depicts a third operational mode of speaker 132 for removing ice 401 from gap 227; specifically, FIG. 7 depicts views 7-I, 7-II of speaker 132 in two positions, in which finger 403 can alternatively apply pressure (as indicated by arrow 704) side-to-side at a top side and/or outer side of speaker pill 225, which causes speaker pill 225 to move side-to-side in cavity 221 (e.g. between the positions in each of view 7-I, 7-II). In these implementations, flexible pads 230 extend towards a side of cavity 221 towards which speaker pill 225 is moving. Such movement causes gap 227 at an edge of speaker pill 225 in contact with ice 401 to expand and contract (e.g. gap 227 has expanded in view 7-I, and contract in view 7-II), which again causes ice 401 to be ejected from gap 227 (e.g. as indicated by arrow 705 in view 7-II). In other words, as gap 227 expands (as in view 7-I), ice 401 can be loosened, and as gap contracts (as in view 7-II), ice 401 can be squeezed out of gap 227.

While the three operational modes of FIG. 5, FIG. 6 and FIG. 7 are depicted as being distinct, one or more of the operational modes can be combined such that both inward pressure and side-to-side pressure is applied to speaker pill 225. Alternatively, pressure can be applied to speaker pill 225 circularly, such that speaker pill 225 moves circularly, either alone or in combination with any of the operational modes depicted in FIG. 5, FIG. 6 and FIG. 7

It is yet further appreciated that pressure need be applied to speaker pill 225 by finger 403; rather such pressure can be applied by other body parts, a stylus, and/or any other device which can apply pressure to speaker pill 225.

Furthermore, in some implementations, pressure need not be applied to speaker pill 225; rather, as speaker pill 225 is mounted on one or more flexible pads 230, vibration of device 101 can generally cause speaker pill 225 to vibrate as depicted in FIG. 7, which can cause ice 401 to be ejected from gap 227. Such situations can occur, for example, when device 101 is one or more of located in a vehicle, mounted in a vehicle, integrated with a vehicle and the like; in other words, vibration of the vehicle can cause device 101 to vibrate which, in turn can cause speaker pill 225 to vibrate.

In the foregoing, specific implementations of a speaker have been described that include a speaker pill mounted to flexible pads. However, one of ordinary skill in the art appreciates that various modifications and changes are within the scope of the present specification. For example, attention is next directed to FIG. 8, which depicts a schematic cross-section of an alternative speaker 132*a* which can be incorporated into housing 109 of device 101, according to non-limiting implementations. Speaker 132*a* is substantially similar to speaker 132, with like elements having like numbers, however in an "800" series rather than a "200 series. Hence device 101 can alternatively comprise: housing 109 comprising an outer surface 209 (as also depicted in FIG. 1) and an inner surface 210 opposite outer surface 209; an audio port 820 at housing 109, audio port 820 comprising: a cavity 821 at outer surface 209 of housing 109; an aperture 823 through housing 109, aperture 823 located in cavity 821; and a speaker pill 825 located in cavity 821 and forming a gap 827 with sidewalls of cavity 821, speaker pill 825 mounted in front of aperture 823 using one or more flexible pads 830 (mounted on respective arms 831); and, a speaker driver 832 located adjacent inner surface 210 of housing 109, and further adjacent aperture 823.

However, in contrast to speaker 132, speaker pill 825 is flexible and generally comprises a flexible material which can include, but is not limited to, rubber, silicone, and the like. Put another way, speaker pill 825 can be pliable and/or deformable, and the like. Such flexibility will be described in more detail below.

As depicted, speaker pill 825 and one or more flexible pads 230 are integrated with each other; for example, speaker pill 825 and one or more flexible pads 230 are formed from one flexible piece. However, in other implementations speaker pill 825 and one or more flexible pads 230 can be separate devices that are joined to one another using any suitable combination of fasteners, glue, epoxy, bonding, and the like.

Figure 8:
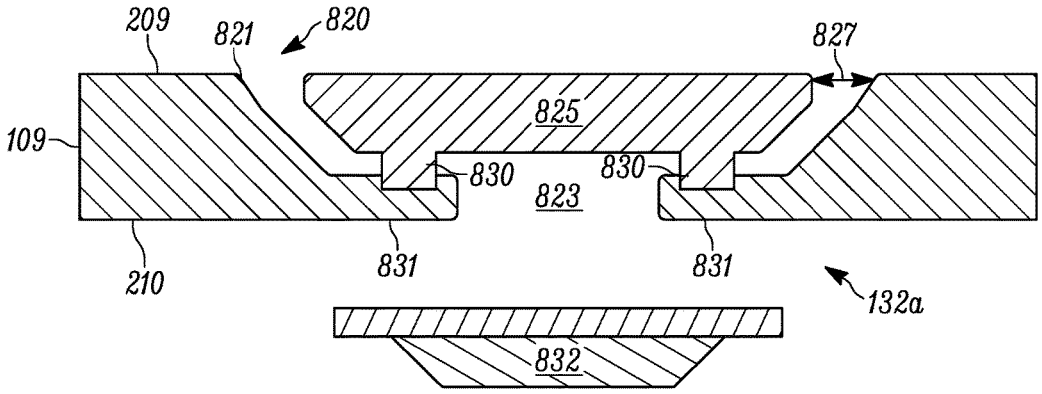
FIG. 8 depicts a schematic cross-section of an ice resistant speaker, according to alternative non-limiting implementations.

Functionality of speaker 132*a* will now be described with reference to FIG. 9 and FIG. 10, each of which are substantially similar to FIG. 8, with like elements having like numbers. In each of FIG. 9 and FIG. 10 it is further assumed that ice 401 has formed in gap 227, and that finger 403 is interacting with speaker pill 825.

Figure 9:
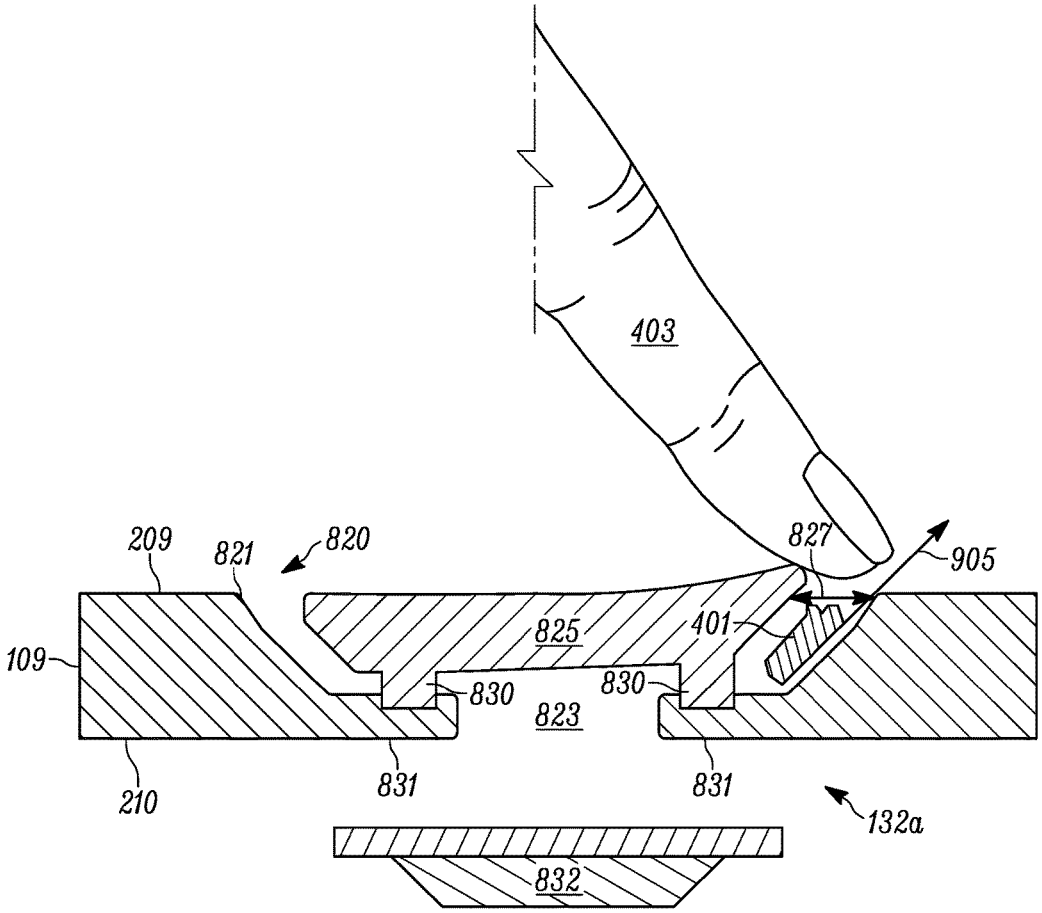
FIG. 9 depicts a finger of a user interacting with the ice resistant speaker of FIG. 8 to eject ice that has formed in a gap, in a first operational mode, according to non-limiting implementations.

With reference to FIG. 9, which depicts a first operational mode of speaker 132, as speaker pill 825 is flexible, finger 403 interact with speaker pill 825 to lift an edge of speaker pill 825 in contact with ice 401 to widen gap 827, which causes ice to be ejected from gap 827 (e.g. as indicated by arrow 905), for example when device 101 is additionally shaken and/or inverted such that widened gap 827 opens downwards towards the ground.

Figure 10:
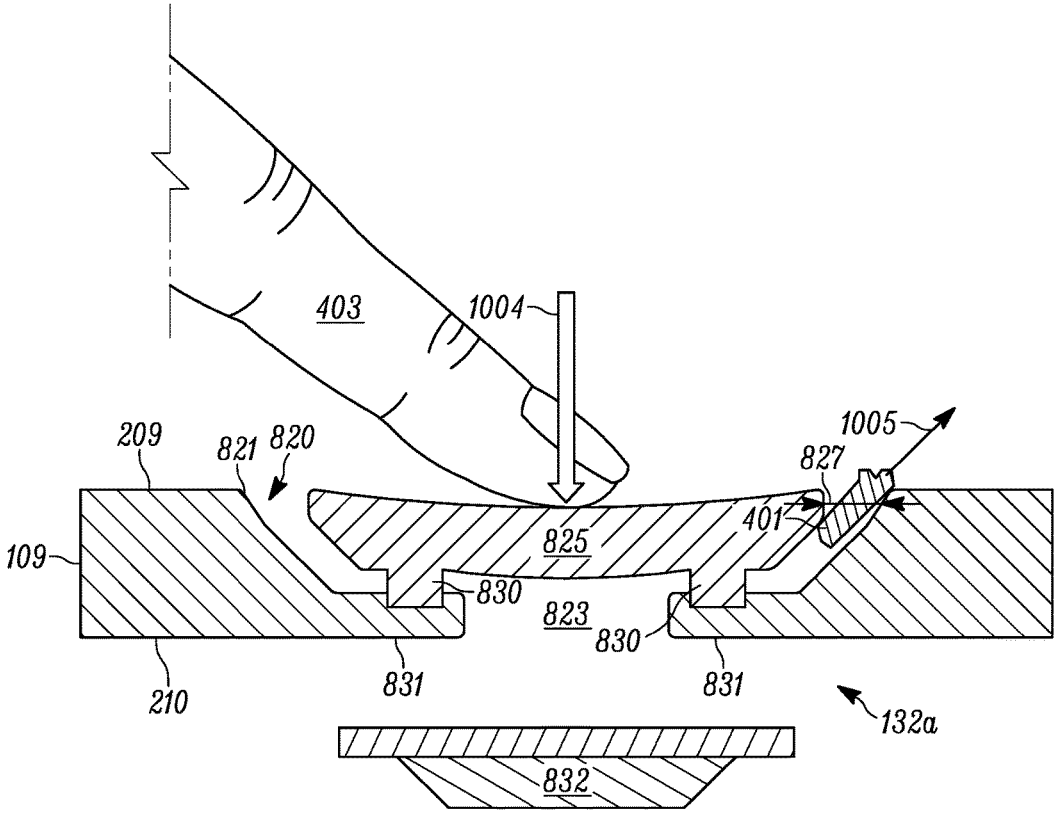
FIG. 10 depicts a finger of a user interacting with the ice resistant speaker of FIG. 8 to eject the ice from the gap, in a second operational mode, according to non-limiting implementations.

Alternatively, with reference to FIG. 10, which depicts a second operational mode of speaker 132, as speaker pill 825 is flexible, finger 403 can apply pressure (as indicated by arrow 1004) to about a center of a top side and/or outer side of speaker pill 825, causing the center of speaker pill 825 to deform into cavity 821, and edges of speaker pill 825 to deform away from cavity 821, which causes ice 401 to be ejected from gap 227 (e.g. as indicated by arrow 1005) as the edge of speaker pill 225 in contact with ice 401 moves outward.

In some implementations, speaker 132*a* can be further modified such that only speaker pill 825 is flexible and not the pads onto which speaker pill 825 are mounted. For example, in some implementations, flexible pads 830 can be replaced with rigid pads and/or posts and flexible speaker pill 825 can be mounted thereto.

In all implementations described herein, one or more of a speaker pill and pads onto which the speaker pill is mounted are flexible. However, also provided herein are speakers in which the general shape and physical configuration of speaker pills and cavities thereof are selected which can reduce the likelihood of ice build-up and/or promote the likelihood that ice formed in a gap between a speaker pill and a cavity will be ejected from the gap.

Figure 11:
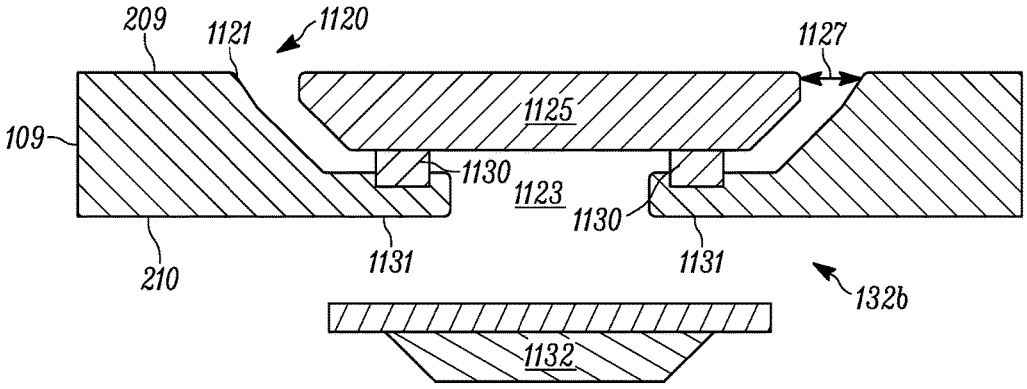
FIG. 11 depicts a schematic cross-section of an ice resistant speaker, according to further alternative non-limiting implementations.

For example, attention is next directed to FIG. 11, which depicts a schematic cross-section of an alternative speaker 132*b* which can be incorporated into housing 109 of device 101, according to non-limiting implementations. Speaker 132*b* is substantially similar to speaker 132, with like elements having like numbers, however in an "1100" series rather than a "200 series. Hence device 101 can alternatively comprise: housing 109 comprising an outer surface 209 (as also depicted in FIG. 1) and an inner surface 210 opposite outer surface 209; an audio port 1120 at housing 109, audio port 1120 comprising: a cavity 1121 at outer surface 209 of housing 109; an aperture 1123 through housing 109, aperture 1123 located in cavity 1121; and a speaker pill 1125 located in cavity 1121 and forming a gap 1127 with sidewalls of cavity 1121, speaker pill 1125 mounted in front of aperture 1123 using pads 1130 (mounted on respective arms 1131); and, a speaker driver 1132 located adjacent inner surface 210 of housing 109, and further adjacent aperture 1123. In general, pads 1130 need not be flexible and indeed, as depicted, pads 1130 are rigid, as is speaker pill 1125, and hence pads 1130 can comprise posts, and the like, onto which speaker pill 1125 is mounted; and/or speaker pill 1125 and pads 1130 can be integrated into one rigid piece mounted to arms 1131.

Corners of each of speaker pill 1125 and cavity 1121 are rounded, which can reduce buildup of ice thereupon, as compared to ice build that occurs on sharp corners and the plurality of edges of speaker grills. Furthermore, edges of both speaker pill 1125 and cavity 1121 are rounded to reduce the likelihood of ice gaining purchase on such edges.

Furthermore, gap 1127 and/or audio port 1120 is continuous, while speaker pill 1125 is aperture-free. In particular, the only mechanical elements present in gap 1127 are pads 1130, a lateral area of which is selected to be minimal as described above. Such implementations result in greater distances along edges as compared to speakers using speaker grills having a plurality of apertures there through, and which hence can relatively increase a distance over which ice can span; hence, ice initially forming in discontinuous patches along edges and sides of speaker 132*a*, has a larger distance to span before the discontinuous patches join up.

In addition, as gap 1127 is continuous, a distance across gap 1127 can be larger than apertures in speaker grills, such that is relatively less likely that ice will build up across gap 1127. Furthermore, to promote ice falling away from and/or out of gap 1127, sides of gap 1127 (including sides of speaker pill 115 and sides of cavity 1121) be generally one or more of smooth, glossy, and generally comprise a low friction surface, such that adherence of ice to sides of gap 1127 is generally reduced as compared to adherence of ice to speakers using speaker grills having a plurality of apertures there through. For example, sides of gap 1127 (including sides of speaker pill 115 and sides of cavity 1121) can comprise a low friction material including, but not limited to, Teflon™, nylon, and the like. Alternatively, sides of gap 1127 can be coated with a hydrophobic coating to reduce water adhesion, and hence ice adhesion.

Furthermore, a top side and/or outer side of speaker pill 1125 can be generally one or more of smooth, glossy, and generally comprise a low friction surface, such that adherence of ice to the top side and/or outer side is generally reduced as compared to adherence of ice to speakers using speaker grills having a plurality of apertures there through. As such, speaker pill 1125 can comprise a low friction material including, but not limited to, Teflon™, nylon, and the like. Alternatively, speaker pill 1125 can be coated with a hydrophobic coating to reduce water adhesion, and hence ice adhesion. In other words, ice forming at the top side and/or outer side of speaker pill 1125 generally falls away. Furthermore, as speaker 132*b* does not comprise a rear face of a speaker grill, it is less likely that ice will build up on an interior of speaker 132*b* and/or fall into speaker driver 232.

Hence, in present implementations, ice build-up can be reduced as compared to speakers using speaker grills having a plurality of apertures there through. In particular, in a speaker using speaker grills having a plurality of apertures there through, ice can build up through and around the apertures, which generally lock the ice in place; in present implementations such issues can be reduced, as corners around which ice can form are comparatively reduced, and there are no apertures in a speaker pill of the present implementations through which ice can form.

Figure 12:
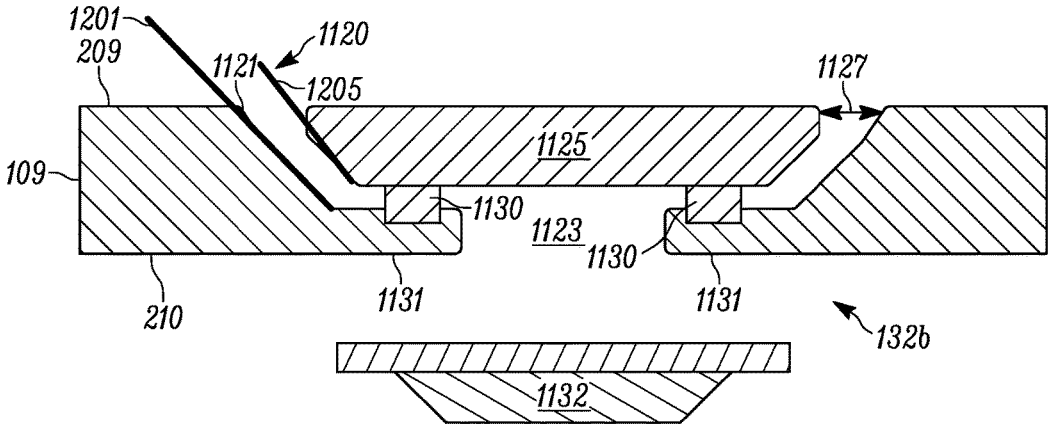
FIG. 12 depicts the ice resistant speaker of FIG. 11, showing a widening of a gap thereof, according to non-limiting implementations.

Attention is next directed to FIG. 12, which is substantially similar to FIG. 11, with like elements having like numbers. However, in FIG. 12, depicts a further detail of speaker 132*b*, and specifically a taper of gap 1127. In particular, in FIG. 12, lines 1201, 1205 are shown, which generally follow respective opposing sides of cavity 1121 and speaker pill 1125. Lines 1201, 1205 are understood not to be present at speaker 132*b*, but are provided merely as guideline to show a widening of gap 1127.

In particular, as clearly seen in FIG. 12, a distance between lines 1201, 1205 widen towards outer surface 209 of housing 109, and hence a distance between opposing sides of cavity 1121 and speaker pill 1125 widens towards outer surface 209 of housing 109. Hence, sides of speaker pill 1125, and sidewalls of cavity 1121 are tapered outwards towards outer surface 209 with respect to one another such that 1127 gap widens from inner surface 210 to outer surface 209 of housing 109.

As is yet further depicted in FIG. 12, sides of speaker pill 1125, and the sidewalls of cavity 1121 can each have a plurality of complementary facets that can extend around each of the sides of speaker pill 1125, and the sidewalls of cavity 1121, each of the plurality of complementary facets (when present) being tapered outwards towards outer surface 209 of housing 109, with respect to one another, such that gap 1127 widens from inner surface 210 to outer surface 209 of housing 109. Indeed, widening of gap 1127 can be provided in any suitable manner; in other words, aesthetics and design of speaker pill 1125 can be varied, as long as gap 1127 widens from inner surface 210 to outer surface 209 of housing 109. Such widening need not be continuous, and furthermore portions of gap 1127 can be parallel and/or not tapered, for example towards an interior of speaker 132*b*.

In any event, such a taper can enable ice to fall out of gap 1127. Furthermore, such tapering can allow for easier removal of ice (and/or debris) using a utensil (e.g. a tip of a knife, an awl, a screw driver, a pen, and the like).

Implementations described herein can be modified to include or exclude various features. For example speakers with flexible speaker pills and/or with flexible mounting pads can be provided without tapered sides and/or without rounded corners, and flexible speaker pills and/or flexible mounting pads can continue to promote ice removal. Similarly, speakers without flexible speaker pills and/or without flexible mounting pads can have rounded corners, rounded edges and smooth surfaces and can be provided without tapering of sides of a gap, and the rounded corners, rounded edge and smooth surfaces can continue to reduce ice buildup. Similarly, speakers without flexible speaker pills and/or without flexible mounting pads can have tapered sides of a gap and can be provided without rounded corners, rounded edge and smooth surfaces, and the tapered sides of the gap can continue to promote ice falling out of the gap.

Furthermore, while implementations that include flexible speaker pills, flexible mounting pads, and tapered sides of a gap are described herein as promoting ejection of ice from a gap, such implementations can also promote ejection of other debris that is not ice, for example dirt, stones, and the like.

Hence, provided herein are various implementations of speakers that can both reduce ice build-up as compared to speakers with speaker grills, and promote ejection of ice and/or other debris from a gap between a speaker pill with continuous external surfaces and sides of a cavity within which the speaker pill resides. Such implementations can also prevent jets of water directly hitting a speaker driver behind a speaker pill, as depicted in any of FIG. 2 and FIG. 4 to FIG. 12. For example, in speakers with speaker grills having a plurality of apertures, water and/or jets of water can pass through the apertures and harm the speaker driver. However, with present implementations, the speaker pill can deflect and/or reflect jets of water. Furthermore, such implementations can further deflect implements impinging on speaker pills, as described herein, as compared to speakers with speaker grills. For example, in speakers with speaker grills having a plurality of apertures, implements, such as styluses, pins, paperclips, and the like, can pass through the apertures and harm and/or damage and/or puncture the speaker driver. However, with present implementations, the speaker pill can deflect the implements.

In the foregoing specification, specific implementations have been described. However, one of ordinary skill in the art appreciates that various modifications and changes can be made without departing from the scope of the specification as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting implementation the term is defined to be within 10%, in another implementation within 5%, in another implementation within 1% and in another implementation within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

I claim:

1. A device comprising:

a housing comprising an outer surface and an inner surface opposite the outer surface;

an audio port at the housing, the audio port comprising: a cavity at the outer surface of the housing; an aperture through the housing, the aperture located in the cavity; and a speaker pill located in the cavity and forming a gap with housing sidewalls of the cavity, the speaker pill mounted in front of the aperture using one or more flexible pads; and, a speaker driver located adjacent the inner surface of the housing, and further adjacent the aperture.

2. The device of claim 1, wherein the speaker pill comprises one or more of a sound reflector and a deflector.

3. The device of claim 1, wherein the speaker pill is one or more of solid, rigid, aperture-free, and having continuous external surfaces.

4. The device of claim 1, wherein a total area of the gap between the speaker pill and the housing sidewalls of the cavity at the outer surface is selected by determining an equivalent area of apertures of a speaker grill replaced by the speaker pill, and setting the total area to the equivalent area of the apertures of the speaker grill.

5. The device of claim 1, wherein a total area of the gap between the speaker pill and the housing sidewalls of the cavity at the outer surface is less than or equal to an area of an outer surface of the speaker pill.

6. The device of claim 1, wherein the speaker pill has a shape complementary to the housing sidewalls of the cavity.

7. The device of claim 1, wherein the speaker pill has a shape complementary to the housing sidewalls of the cavity, and respective corners of each of the speaker pill and the housing sidewalls are rounded.

8. The device of claim 1, wherein each of sides of the speaker pill and the housing sidewalls of the cavity are one or more of smooth, glossy, and coated with a hydrophobic material.

9. The device of claim 1, wherein sides of the speaker pill and the housing sidewalls of the cavity are tapered outwards towards the outer surface with respect to one another such that the gap widens from the inner surface to the outer surface of the housing.

10. The device of claim 1, wherein sides of the speaker pill and the housing sidewalls of the cavity each have a plurality of complementary facets that extend around each of the sides of the speaker pill and the housing sidewalls of the cavity, each of the plurality of complementary facets being tapered outward towards the outer surface with respect to one another such that the gap widens from the inner surface to the outer surface of the housing.

11. The device of claim 1, wherein the speaker pill is flexible.

12. The device of claim 1, wherein the one or more flexible pads each extend between a housing side of the cavity that is adjacent the aperture and the speaker pill.

13. The device of claim 1, wherein each of the one or more flexible pads extends from an adjacent arm that extends into the aperture to the speaker pill.

* * * * *